United States Patent [19]

Robinson

[11] 4,201,140

[45] May 6, 1980

[54] DEVICE FOR INCREASING EFFICIENCY OF FUEL

[76] Inventor: T. Garrett Robinson, P.O. Box 128, Galena, Md. 21635

[21] Appl. No.: 34,411

[22] Filed: Apr. 30, 1979

[51] Int. Cl.[2] ..... F23K 5/00

[52] U.S. Cl. ..... 110/218; 110/342; 110/347; 210/222

[58] Field of Search ..... 110/218, 342, 347; 431/3; 210/222, 223; 335/209; 55/100

[56] References Cited

U.S. PATENT DOCUMENTS

| | | | |
|---|---|---|---|
| 2,652,925 | 9/1953 | Vermeiren | 210/222 |
| 2,789,655 | 4/1957 | Michael et al. | 55/100 |
| 3,059,910 | 10/1962 | Moriya | 210/222 X |
| 3,349,354 | 10/1967 | Miyata | 335/209 |
| 3,680,705 | 8/1972 | Happ et al. | 210/222 |

FOREIGN PATENT DOCUMENTS 814269 6/1959 United Kingdom .

*Primary Examiner*—Edward G. Favors
*Attorney, Agent, or Firm*—Connolly and Hutz

[57] ABSTRACT

A device for increasing efficiency of fuel includes a first chamber having a plurality of vertically arranged sets of magnets with a distributor feeding the liquid fuel therein; a second chamber downstream from the first chamber acts upon the fuel after it has undergone treatment by the magnets; and a third chamber having vertically arranged sets of magnets further treats the fuel before it is fed to a burner.

19 Claims, 12 Drawing Figures

DEVICE FOR INCREASING EFFICIENCY OF FUEL

BACKGROUND OF INVENTION

Various devices exist for treating fuel. For example, U.S. Pat. No. 3,349,454 exemplifies one such device wherein fuel is fed into a magnet assembly which includes a hollow non-magnetic casing having an axial passageway with the magnets arranged so that like poles are oriented toward the axis. In that arrangement the fuel flows along the casing axis and is thereby surrounded by the magnets before exiting into a chamber which includes a rod connected to a source of E.M.F. With this arrangement the fuel is subjected to the combined effects of a very strong magnetic flux and then to the influence of an electric field.

Other arrangements exist such as disclosed in Canadian Pat. No. 574,147 (U.K. Pat. No. 814,269) which attempt to increase the combustion efficiency of fuel by subjecting the fuel to the effects of a magnetic flux and the influence of electrodes. U.S. Pat. No. 3,680,705 also uses magnets to treat liquids for containing calcareous matter.

SUMMARY OF INVENTION

An object of this invention is to provide a device for increasing the efficiency of fuel in a simple and effective manner.

A further object of this invention is to provide such an arrangement which is particularly adaptable for treating liquid fuel.

A still further object of this invention is to provide an arrangement which is capable of increasing the efficiency of coal fuel, such as coal dust, and which embodies many of the principles of the device for treating liquid fuel.

In accordance with one embodiment of this invention, liquid fuel is treated by distributing the fuel into a first chamber having sets of vertically arranged magnets which subject the fuel to a magnetic flux. Downstream from the first chamber is an electrode chamber which applies an electrostatic field to the thus treated fuel. A second magnet chamber completes the magnetic treatment of the fuel before it is fed to the burner.

In the preferred embodiment of this invention the electrode chamber includes electrodes having a predetermined surface area in accordance with the diameter size of the chamber.

In accordance with a further aspect of this invention another embodiment is particularly adapted for treating coal fuel which may be supplied, for example, in an oil carrier. The coal fuel is fed into a first magnet chamber which includes magnets for initially applying a magnetic force to the material being treated and has downstream therefrom magnetic probes which extend therein for removing sulfur and other magnetically attractable materials. The thusly treated coal fuel is then fed into a second magnet chamber which subjects the fuel to a magnetic flux immediately before the fuel is fed into the burner.

THE DRAWINGS

DETAILED DESCRIPTION

Figure 1:
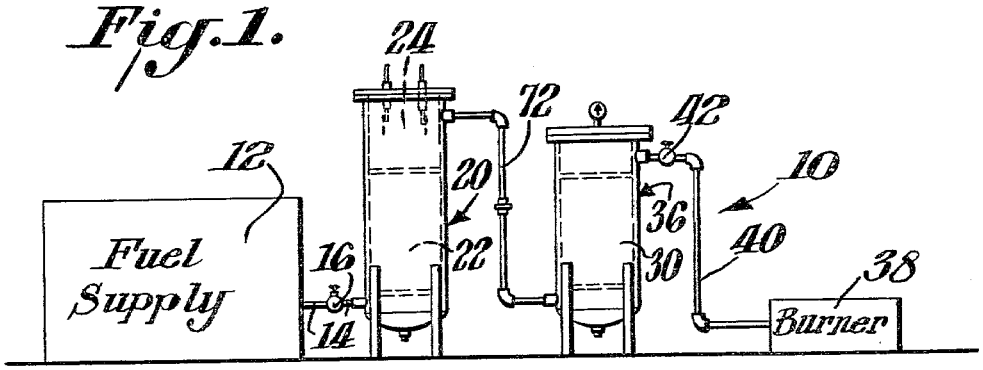
FIG. 1 is a schematic view in elevation of a device in accordance with one embodiment of this invention.

FIGS. 1-9 show one embodiment of this invention which is particularly designed for the treatment of fuel such as fuel oil of the various conventional types. More particularly, device 10 is designed to increase the combustion efficiency of the liquid fuel. As illustrated in FIG. 1, device 10 includes a fuel supply chamber 12 of any suitable construction having a discharge pipe 14 so that fuel flows therethrough as controlled in any suitable manner such as by valve 16. From pipe 14 the fuel flows into inlet chamber 18 of vertically disposed housing or casing 20. A first magnet chamber 22 is provided above and in flow communication with inlet chamber 18 while an electrode chamber 24 is provided downstream from magnet chamber 22 all of which are conveniently mounted in the same housing 20.

Although the theory upon which the invention is successful is not completely understood, it is believed that the first magnet chamber 22 with its sets 26 of vertically arranged magnets applies a magnetic flux to the fuel oil which apparently cause a randomization of its molecules to take place under its magnetic force. It is then believed that the randomized molecular arrangement is fixed under the influence of an electrostatic force applied by electrodes 28 in electrode chamber 24.

In accordance with this invention a second magnet chamber 30 is provided downstream from electrode chamber 24. Apparently the second magnet chamber 30 maximizes the efficiency of the practice of the invention by its sets 32 of vertically arranged magnets acting to complete the randomization of the molecular arrangement in the fuel thereby effectively complementing the initial randomization.

In the preferred embodiment of this invention electrode chamber 24 is mounted downstream from first magnet chamber 22 and in fact it is common housing 20. It is to be understood, however, that the concepts of this invention may be practiced by having an electrode chamber with its electrodes 34 downstream from second magnet chamber 30 as illustrated in phantom in FIG. 2. This provision of electrodes 34 downstream from second magnet chamber 30 may be either in addition to electrodes 28 in chamber 24 or instead of those prior electrodes. Similarly electrode chamber 24 may be mounted intermediate magnet chambers 22 and 30 but in a separate housing or may be in the lower portion of housing 36 for second magnet chamber 30.

After the fuel has been subjected to the double magnet dose and electrostatic field, the thusly treated fuel is fed into burner 38. FIG. 1, for example, illustrates a feed pipe 40 with its valve 42 to control the feed of fuel to burner 38.

It has been found that with the practice of this invention there is an increase by ten percent of the heat value using number two fuel oil. Additionally with the practice of this invention there has been a significant decrease in the lower stack temperature. In this respect, for example, the lower stack temperature has been 290°0 F. with the practice of the invention as compared to a more normal temperature of 350° F. Similarly the practice of the invention results in an increase in the firebox temperature to, for example, 200° F.

Figure 3:
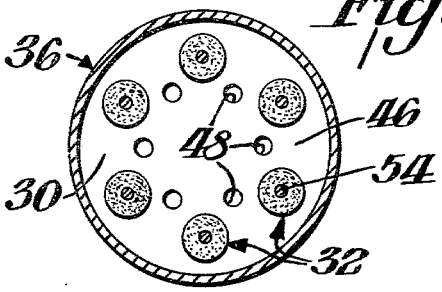
FIG. 3 is a cross-sectional view taken through FIG. 2 along the line 3—3.
Figure 2:
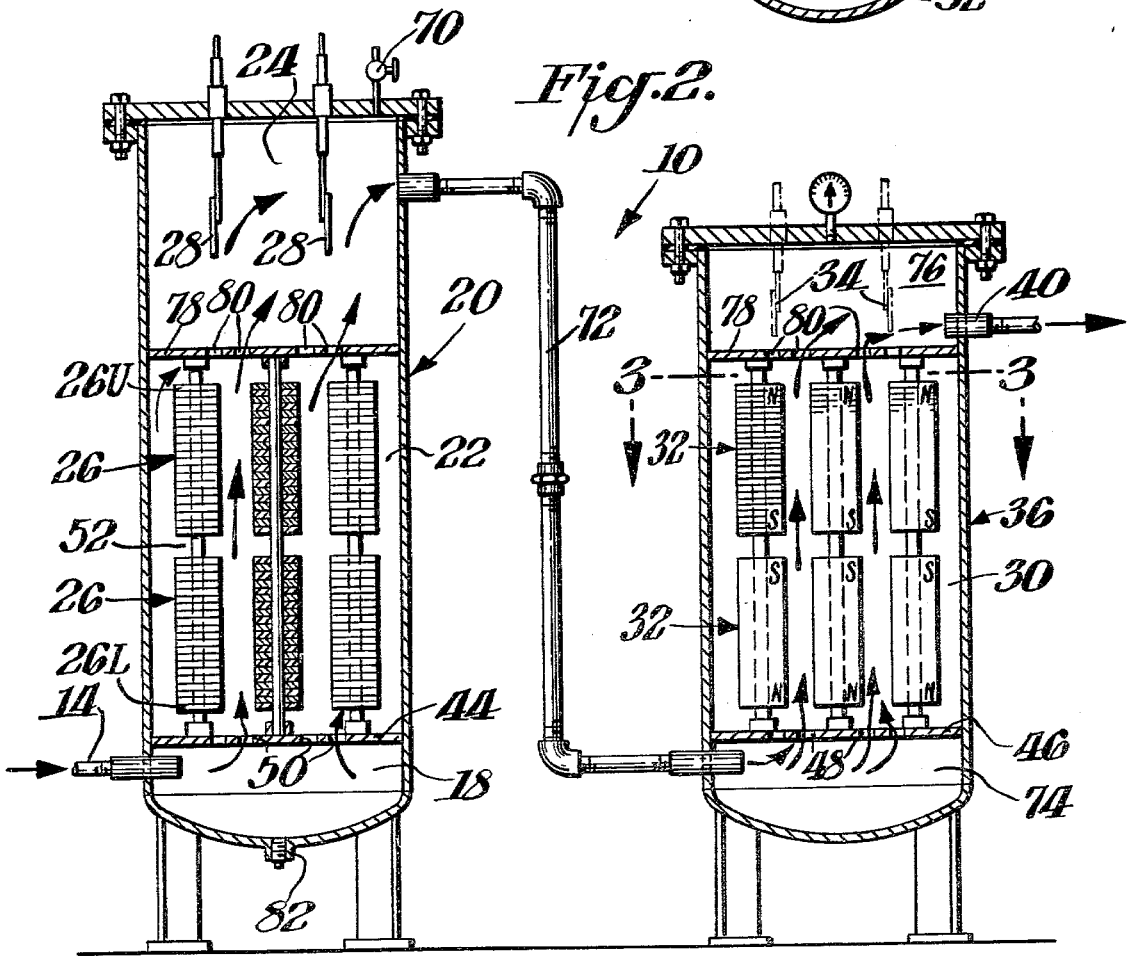
FIG. 2 is a cross-sectional view in elevation of a portion of the device in FIG. 1.

The invention may be practiced with various structural arrangements. For example, FIG. 2 illustrates distributor means 44 between inlet chamber 18 and first magnet chamber 22. In the illustrated form, distributor means 44 comprises a plate having a series of spaced apertures so that the fuel is fed into chamber 22 in a predetermined pattern designed to maximize the effect of the magnetic flux operating upon the fuel. A similar plate 46 would likewise be provided for second magnet chamber 30. FIG. 3 illustrates an arrangement of six sets of vertically disposed magnets 26 in a circular pattern within chamber 30. Such arrangement might also be used in first magnet chamber 22. FIG. 3 further illustrates plate 46 to have a series of distributor holes 48 disposed in a circular pattern concentric to but within the circular array of magnets 26. Such an arrangement would likewise be used in plate 44 with the provision of holes 50.

Figure 4:
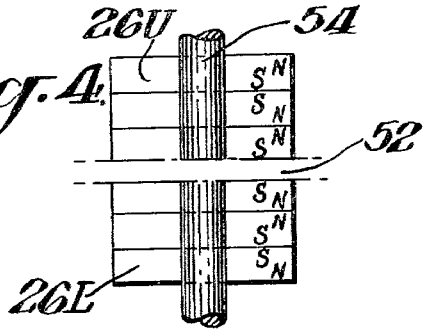
FIG. 4 is an elevation view partly in section of a portion of one of the magnet assemblies shown in FIG. 2.

Any suitable number of sets of magnets 26, 30 may be used within the concepts of this invention. Preferably, however, an even number is used as low as two sets of magnets particularly where the same poles are adjacent each other at the gap 52 between the magnets of each set. In the embodiment as illustrated in FIGS. 2–4, the sets of magnets 26 are constructed by providing a solid core 54 which may be in the form of a solid rod or a tube having its ends closed. Two sets of ring magnets are mounted around core 54. The outer surfaces of lowermost magnet $26_L$ and the uppermost magnet $26_u$ are of the same polarity. More specifically, in the illustrated embodiment, the north poles of each magnet $26_L$ and $26_u$ are mounted outermost. As previously indicated and as illustrated, the upper set of magnets 26 and lower set of magnets 26 are spaced from each other at gap 52 in the generally longitudinally central area of the core, with the magnets mounted opposite each other at gap 52 being of the same polarity which is of a polarity opposite that of the remote ends of magnets $26_L$ and $26_u$. Thus in the illustrated embodiment, the north poles are at the extreme ends of the sets of magnets and the south poles are disposed opposite each other at gap 52. The sets of magnets 32 would likewise have the same polarity arrangement.

Figure 5:
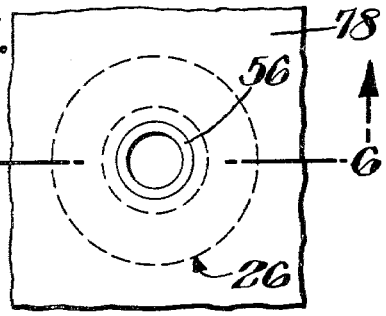
FIG. 5 is a plan view of an alternative magnet assembly usable in the device of FIGS. 1-2.
Figure 6:
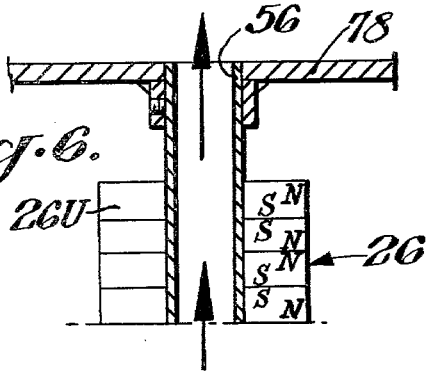
FIG. 6 is a cross-sectional view in elevation taken through FIG. 5 along the line 6—6.

FIGS. 5–6 show a modified form of magnet structure. In this arrangement core 56 is hollow to provide a passageway for the fuel. Thus the apertures in the distributor plates would be located in line with the passageways provided by hollow cores 56. The polarity of the ring magnets and spacing therefore would otherwise be the same as in FIGS. 2 and 4.

Figure 7:
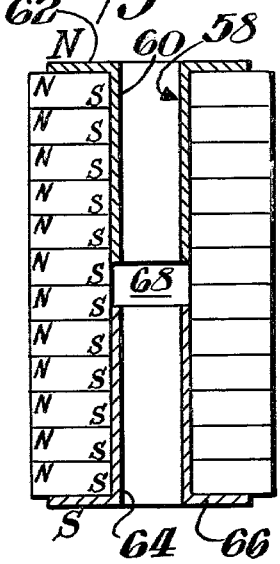
FIG. 7 is a cross-sectional view in elevation of a further alternative magnet assembly.

FIG. 7 shows yet another form of magnet arrangement. As indicated therein, hollow core 58 is formed by an upper cup-like section 60 having an outer flange 62 and a lower cup-like section 64 having an outer flange 66. Cup-like sections 60, 64 are spaced from each other to create a gap 68 therebetween in the longitudinally central area of core 58. Sections 60, 64 are themselves made of magnet materials with the polarity of flanges 62, 66 being opposite each other and with the outermost portion of the ring magnets mounted thereon being of the same polarity as its juxtaposed flange. This arrangement is particularly desirable since the fuel would be fed through hollow cores 58 under the combined magnetic flux influence of the cup-like sections 60, 64, with a gap created in the central area where the flux would otherwise be weakest so that the fuel is under the direct influence of the ring magnets at gap 68.

Figure 8:
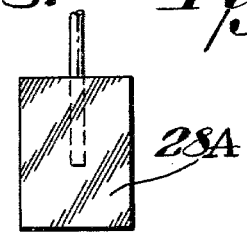
FIG. 8 is an elevation view of an electrode which is usable in the device of FIG. 2.
Figure 9:
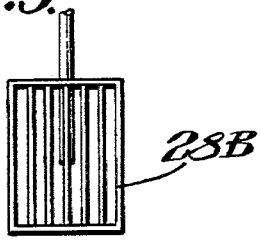
FIG. 9 is an elevation view similar to FIG. 8 of a modified form of electrode.

The provision of electrodes 28 represents an important aspect of this invention. Any suitable structure may be used such as known in the prior art wherein, for example, the electrodes are powered by AC current in a voltage range of 220–440. FIGS. 8–9 show two particularly preferable forms for the electrodes. As indicated in FIG. 8, electrode 28A is in the form of a flat plate while electrode 28B of FIG. 9 is in the form of a grid. The electrodes are designed to carry voltage to the calibrated sized plates 28A and 28B and have a predetermined surface area with respect to the inside diameter of chamber 24 so as to apply the proper electrostatic field to the fuel. In the preferred form of this invention, electrode plates 28A and 28B have one square inch total surface area for each inch of inside diameter of chamber 24.

Electrode chamber 24 further includes vent 70 and outlet pipe 72 so that the treated fuel may be fed into inlet section 74 of housing 36 upstream from plate 46. As previously noted, a second electrode chamber 76 may be provided downstream from second magnet chamber 30 or chamber 76 and may simply function as an outlet chamber from which the treated fuel is fed into pipe 40 to the burner 38.

As illustrated in FIG. 2, outlet plates 78 are provided at the downstream end of each magnet chamber 22, 30. Plates 78 include a plurality of spaced orifices 80 which are of larger number and diameter than orifices 48, 50 in plates 46, 44. Advantageously, these plates serve the additional function of supporting the sets of magnets. Thus the cores for magnets 26 are supported by and between plates 44, 78 in the first vessel 20 while sets of magnets 32 are supported by and between plates 46, 78 in the second vessel 36. Each vessel 20, 36 is preferably made of a metal which may be of a magnetic material. In the illustrated arrangement of FIG. 2, each vessel 20, 36 has a twelve inch outside diameter while the magnets 26, 32 have an outside diameter of about 2⅜ inches. Cores 54 are made of non-magnetic rods about one half inch in diameter, while cores 56 are metal. Advantageously, inlet chamber 18, first magnet chamber 22 and electrode chamber 24 are conveniently mounted in the same housing with a drain 82 being provided at the lower end of inlet chamber 18. Where a twelve inch vessel 20 is used as in the illustrated embodiment, it is preferable to provide six sets of magnets as shown in FIG. 3. The number of sets of magnets would vary in accordance with the size of vessel. Thus, for example, fifteen sets of magnets would be used for a twenty-four inch vessel. The various magnets described herein may be permanent or electromagnets.

The embodiment of FIGS. 1-9 is particularly advantageous for cutting down on the sulphur in the fuel and causing decomposition thereof prior to burning. As previously indicated, the effect of the combined electrostatic field and double magnetic field results in an increased combustion efficiency of the fuel.

Figure 10:
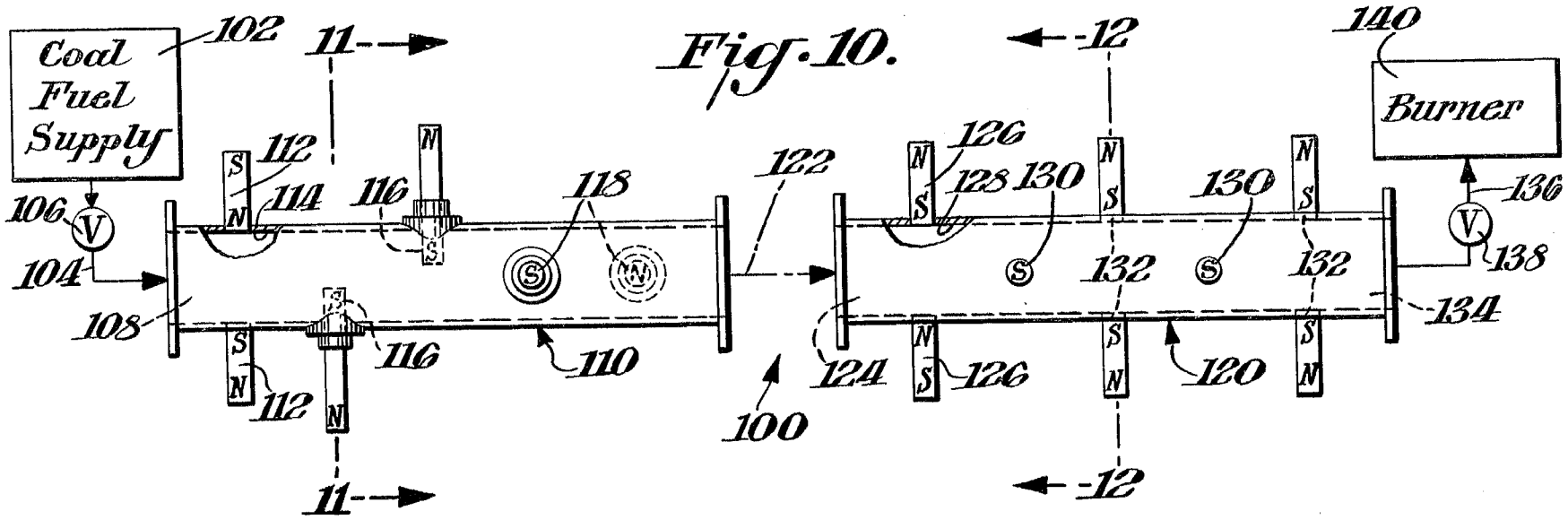
FIG. 10 is a schematic elevation view partly in section of a further embodiment of this invention particularly adapted for treating coal fuel such as coal dust.
Figure 12:
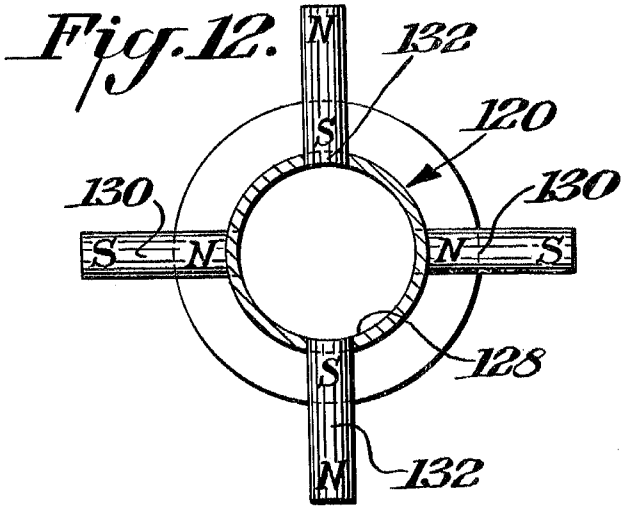
FIG. 12 is a cross-sectional view taken through FIG. 10 along the line 12—12.
Figure 11:
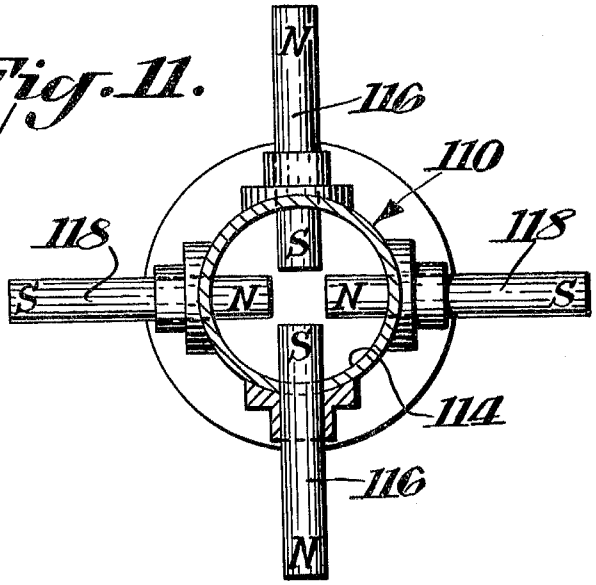
FIG. 11 is a cross-sectional view taken through FIG. 10 along the line 11—11.

FIGS. 10-12 illustrate a further embodiment of this invention which is particularly adapted to increasing the efficiency of coal fuel such as coal dust and the like. In this arrangement, device 100 includes a coal fuel supply 102 wherein the coal fuel is carried by a liquid carrier such as oil and fed through pipe 104 provided with a suitable control valve 106 into the inlet 108 of a first generally horizontally disposed magnet chamber 110. A set of magnets 112 such as permanent or electromagnets is provided at the entrance end of chamber 110 with the inner ends of magnet 112 being flush with the inner surface 114 of chamber 110. Magnets 112, which are referred to herein as an entrance set of magnets, are of opposite polarity to each other at surface 114. Magnets 112 function to initially magnetize the magnetizable impurities in the coal dust. Chamber 110 includes, downstream from entrance magnets 112, a plurality of magnetic probes which are arranged in pairs 116, 118. As illustrated in FIGS. 10-11, probes 116, 118 extend into chamber 110 beyond surface 114 and functions to collect the magnetically attractable impurities. As also illustrated in FIG. 10, the sets of magnetic probes are arranged in a staggered manner with the first set 116 having, for example, its south poles disposed within chamber 110 and the second set 118 having its north poles disposed with chamber 110. Although only two staggered sets 116, 118 of magnets are shown, chamber 110 may include further sets wherein alternate pairs would be of the same polarity and of opposite polarity to the intermediate sets of magnets.

As best shown in FIG. 11, probes 116, 118 are detachably mounted to chamber 110 so that the probes may be periodically removed either manually or mechanically for cleaning since the probes would collect the magnetically attractable impurities.

As also illustrated in FIG. 10, a second magnet chamber 120 is provided downstream from first magnet chamber 110 and likewise is generally horizontally disposed. The fuel treated in first chamber 110 is fed through flow passage means such as pipe 122 into the entrance 124 of chamber 120. A first pair of magnets 126, 126 is provided at entrance 124 generally flush with the inner surface 128 of chamber 120. This first set of magnets 126, 126 which is referred to as an entrance set of magnets is of opposite polarity at surface 128. Downstream from entrance set of magnets 126, 126 a plurality of pairs of sets of magnets 130, 132 are located flush with inner surface 128. The magnets in each pair 130 are disposed in line with each other and are of the same polarity while the magnets 132 in each intermediate pair are displaced 90° (FIG. 12) from magnets 130, and magnets 132 are of the same polarity as each other at surface 128 which is of an opposite polarity to magnets 130.

Chamber 120 apparently functions similarly to the magnet chambers in the prior embodiment so as to randomize the molecular arrangement in the fuel after the magnetically attractable impurities such as sulphur have been removed therefrom, and the thusly treated fuel is then fed from outlet 134 into pipe 136 provided with a suitable valve 138 to burner 140.

The provision of means such as probes is desirable in this embodiment wherein the fuel is coal dust since unlike the liquid fuel treated in the prior embodiment, sulfur represents a significant impurity. With liquid fuel, however, the sulfur does not present much of a problem because it is burned out and is present in a lesser amount. It is further noted that with this second embodiment, an additional randomizing unit and an electrode chamber are not required.

The dimensions of device 100 may, of course, vary. In a preferred practice of the invention, copper tubing is used in chambers 110, 120 and one foot per second fuel is fed for each three inch outside diameter of the tubing. This would be twenty gallons per minute of flow. With the arrangement of FIG. 10 a ten percent increase should occur in a calorimeter test.

The two exemplary embodiments of this invention thereby provide means whereby the efficiency of fuel whether a liquid fuel or coal fuel can be dramatically increased. In view of the present energy crunch, any device which provides efficiency in fuel consumption is highly desirable. It is to be understood that while specific exemplary embodiments have been shown, the invention may be practiced with modification within the spirit thereof. Thus, for example, while the distributor means in the first embodiment has been shown as a plate completely spanning its chamber, other structures such as a ring or doughnut type distributor may be used which directs the fuel into the magnet chamber. Other modifications would also be apparent to one skilled in the art given the teachings of this invention.

What is claimed is:

1. A device for increasing the efficiency of fuel comprising an inlet chamber into which the fuel is fed, a first magnet chamber disposed downstream from said inlet chamber, distributor means connecting said inlet chamber to said first magnet chamber for feeding the fuel from said inlet chamber into said first magnet chamber in a predetermined array of spaced locations, a plurality of sets of vertically arranged magnets located in said first magnet chamber for applying a magnetic flux to the fuel flowing therethrough, an electrode chamber downstream from said first magnet chamber, said electrode chamber having electrode means for applying an electrostatic force to the magnetically treated fuel, a second magnet chamber downstream from said first magnet chamber and having inlet means for feeding the treated fuel therein, said second magnet chamber having a plurality of sets of vertically arranged magnets for applying a further magnetic flux to the treated fuel before the fuel is fed to a burner, and outlet means for said second magnet chamber for discharging the treated fuel therefrom.

2. The device of claim 1 wherein said electrode chamber is downstream from said second magnet chamber.

3. The device of claim 1 wherein said electrode chamber is disposed between said first magnet chamber and said second magnet chamber.

4. The device of claim 3 wherein said electrode chamber is mounted vertically above said first magnet chamber in a common housing.

5. The device of claim 1 wherein each of said sets of said magnets comprises a solid core having a plurality of magnets mounted thereon with a gap being disposed between the magnets in the longitudinally central area of said core.

6. The device of claim 5 wherein each of said sets of magnets include magnets having like poles disposed toward each other at said gap.

7. The device of claim 1 wherein said sets of magnets are in a generally circular arrangement, and said distributor means comprises a plate having a plurality of holes circularly arranged concentrically within the circular arrangement of said sets of magnets.

8. The device of claim 1 wherein each of said sets of magnets includes a hollow core with magnets mounted therearound, and said distributor means includes a plate having a plurality of apertures aligned with said hollow cores for directing fuel through said hollow cores.

9. The device of claim 8 wherein said sets of magnets include a plurality of ring magnets having like poles adjacent each other.

10. The device of claim 8 wherein each of said sets of magnets includes a lower cup-like core section and an upper cup-like core section made of magnetic material to comprise said hollow cores, said upper cup-like section and said lower cup-like section being spaced from each other in longitudinally central areas of said core, a plurality of ring magnets being mounted around said core between the flanges of said upper cup-like section and said lower cup-like section including in said spacing therebetween whereby the fuel being treated is directly subjected to the magnetic flux of said magnets in said spacing.

11. The device of claim 10 wherein said flanges of said upper cup-like section and lower cup-like section are of opposite polarity.

12. The device of claim 1 wherein said electrodes have a total surface area of one square inch for each inch of inside diameter of said electrode chamber.

13. The device of claim 1 wherein each of said sets of magnets includes a pair of longitudinally arranged upper and lower magnet assemblies spaced from each other, the polarity of the uppermost and lowermost magnets being the same as each other, and the magnets disposed toward each other across from the spacing therebetween having the same polarity as each other which is of opposite polarity than said uppermost and lowermost magnets.

14. The device of claim 1 wherein said second magnet chamber includes distributor means at its upstream end thereof, each of said distributor means being a plate located below its respective plurality of sets of vertically arranged magnets, each of said plates having a plurality of apertures through which the fuel may pass, and each of said plates further functioning as support means for its respective plurality of sets of vertically arranged magnets.

15. A device for increasing the efficiency of fuel such as coal dust or the like which is transported with a liquid carrier comprising a first generally horizontally disposed magnet chamber having an inlet and an outlet, and entrance set of magnets located at the inner surface of said chamber generally adjacent to said inlet, a plurality of magnetic probes downstream from said entrance set of magnets and extending into said chamber for collecting magnetically attractable impurities in the fuel, a second magnet chamber downstream from said first magnet chamber and having an inlet and an outlet, flow passage means joining said outlet of said first magnet chamber to said inlet of said second magnet chamber whereby fuel treated in said first magnet chamber can be fed into said second magnet chamber, an entrance set of magnets in said second magnet chamber located in the general area of said inlet of said second magnet chamber at the inner surface of said second magnet chamber, and a plurality of sets of magnets downstream from said entrance set of magnets mounted to said second magnet chamber and located at the inner surface thereof, and means for feeding the thus treated fuel from said outlet of said second magnet chamber to a burner.

16. The device of claim 15 wherein the magnets of said entrance set of magnets in said first magnet chamber are of opposite polarity, at said inner surface of said first magnet chamber, and said plurality of magnetic probes including a first staggered set of magnets of the same polarity as each other extending into said inlet chamber and a second set of staggered magnets of the same polarity as each other and of opposite polarity than said first set of staggered magnets.

17. The device of claim 16 wherein said magnetic probes are detachably mounted to said first magnet chamber whereby said probes may be removed therefrom and cleaned.

18. The device of claim 17 wherein the magnets of said entrance set of magnets in said second magnet chamber are of opposite polarity at said inner surface of said second magnet chamber, and said plurality of sets of magnets including a plurality of pairs of magnets wherein alternate pairs are of the same polarity at said inner surface of said second magnet chamber and are of an opposite polarity to the intermediate pairs of said magnets.

19. The device of claim 18 wherein the magnets of said entrance set of magnets in said second magnet chamber are of opposite polarity at said inner surface of said second magnet chamber, and said plurality of sets of magnets including a plurality of pairs of magnets wherein alternate pairs are of the same polarity at said inner surface of said second magnet chamber and are of an opposite polarity to the intermediate pairs of said magnets.

* * * * *